US010741975B2

(12) United States Patent
Jones et al.

(10) Patent No.: US 10,741,975 B2
(45) Date of Patent: Aug. 11, 2020

(54) SHEILDED CABLE ASSEMBLY AND ELECTROMAGNETIC SHIELD TERMINAL ASSEMBLY FOR SAME

(71) Applicant: Aptiv Technologies Limited, St. Michael (BB)

(72) Inventors: Leslie L. Jones, Garrettsville, OH (US); Nicole L. Liptak, Cortland, OH (US); Michael D. Messuri, Canfield, OH (US); Jared Bilas, North Bloomfield, OH (US); Michael J. Demonica, Cortland, OH (US); Christopher A. Margrave, Ashtabula, OH (US); Dominic A. Messuri, Canfield, OH (US); James P. Schuster, Damascus, OH (US)

(73) Assignee: APTIV TECHNOLOGIES LIMITED, St. Michael (BB)

( * ) Notice: Subject to any disclaimer, the term of this patent is extended or adjusted under 35 U.S.C. 154(b) by 0 days.

(21) Appl. No.: 16/567,384

(22) Filed: Sep. 11, 2019

(65) Prior Publication Data

US 2020/0127421 A1 Apr. 23, 2020

Related U.S. Application Data

(60) Provisional application No. 62/747,820, filed on Oct. 19, 2018.

(51) Int. Cl.

| | |
|---|---|
| ***H01R 13/658*** | (2011.01) |
| ***H01R 13/6583*** | (2011.01) |
| ***H01R 4/18*** | (2006.01) |

(52) U.S. Cl.
CPC ..... *H01R 13/6583* (2013.01); *H01R 4/185* (2013.01)

(58) Field of Classification Search
CPC .... H01R 13/6583; H01R 4/185; H01R 4/187; H01R 4/188
See application file for complete search history.

(56) References Cited

U.S. PATENT DOCUMENTS 6,210,223 B1 * 4/2001 Aoyama ..... H01R 4/184 439/585
7,794,274 B2 9/2010 Phillips, Jr.
(Continued)

FOREIGN PATENT DOCUMENTS

EP 1005106 A2 5/2000

*Primary Examiner* — Xuong M Chung Trans
(74) *Attorney, Agent, or Firm* — Billion & Armitage; Michael A. Collins

(57) ABSTRACT

An electromagnetic shield terminal assembly configured for attachment to a shielded cable includes a tubular inner ferrule having a flared attachment end configured to be disposed intermediate the shield conductor and the inner insulation layer of the cable and a crimped outer ferrule formed of sheet metal having a cable attachment portion that defines a pair of bypass crimp wings and a pair of insulation crimp wings. Each insulation crimp wing defines a prong having a pointed end that penetrates the outer insulation layer of the cable. The flared attachment end of the inner ferrule is located intermediate the bypass crimp wings and the insulation crimp wings when the outer ferrule is crimped to the shielded cable.

23 Claims, 5 Drawing Sheets

(56) References Cited

U.S. PATENT DOCUMENTS

| | | | | |
|---|---|---|---|---|
| 7,927,136 | B2 * | 4/2011 | Miyashita | H01R 9/0524 439/585 |
| 8,277,249 | B2 * | 10/2012 | Koga | H01R 4/185 29/867 |
| 8,485,853 | B2 * | 7/2013 | Seifert | H01R 4/188 439/882 |
| 9,667,000 | B1 | 5/2017 | Morello et al. | |
| 9,673,578 | B1 | 6/2017 | Lane | |
| 9,762,001 | B2 | 9/2017 | Morello et al. | |
| 9,929,519 | B1 * | 3/2018 | Hall | H01R 13/405 |
| 9,960,504 | B2 * | 5/2018 | Hikosaka | H01R 9/0518 |
| 9,960,550 | B2 | 5/2018 | Ensley et al. | |
| 10,008,786 | B2 | 6/2018 | Brantingham | |
| 2012/0202372 | A1 | 8/2012 | Hardy et al. | |
| 2013/0319761 | A1 * | 12/2013 | Furukawa | H01R 43/048 174/74 R |
| 2018/0375233 | A1 | 12/2018 | Morello et al. | |

* cited by examiner

SHEILDED CABLE ASSEMBLY AND ELECTROMAGNETIC SHIELD TERMINAL ASSEMBLY FOR SAME

CROSS-REFERENCE TO RELATED APPLICATION

This application claims the benefit under 35 U.S.C. § 119(e) of U.S. Provisional Patent Application No. 62/747,820 filed on Oct. 19, 2018, the entire disclosure of which is hereby incorporated by reference.

TECHNICAL FIELD OF THE INVENTION

The invention generally relates to shielded cable assembly particularly to a shielded cable assembly with an electromagnetic shield terminal assembly.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

Reference will now be made in detail to embodiments, examples of which are illustrated in the accompanying drawings. In the following detailed description, numerous specific details are set forth in order to provide a thorough understanding of the various described embodiments. However, it will be apparent to one of ordinary skill in the art that the various described embodiments may be practiced without these specific details. In other instances, well-known methods, procedures, components, circuits, and networks have not been described in detail so as not to unnecessarily obscure aspects of the embodiments.

Figure 1:
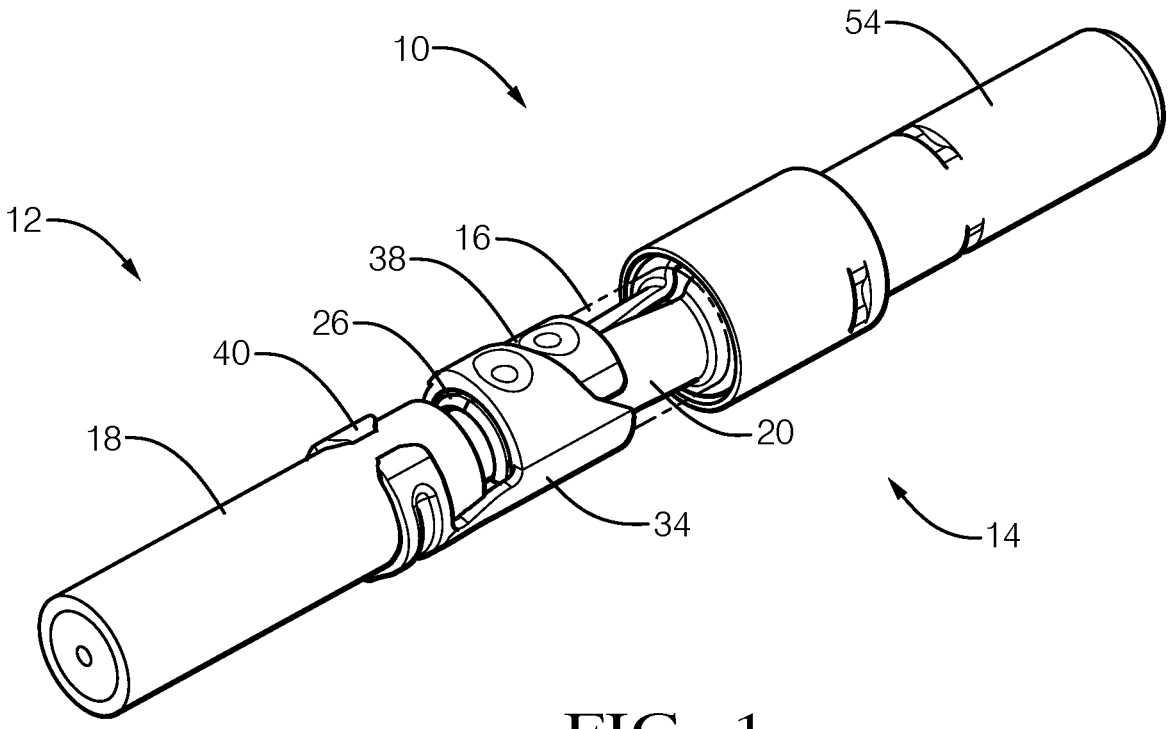
FIG. 1 is a perspective view of an electromagnetic shield terminal assembly, according to one embodiment of the invention.

FIG. 1 illustrates an embodiment of a shielded cable assembly 10 that includes an electromagnetic shield terminal assembly 14 to provide electromagnetic shielding to an electrical terminal (not shown) connected to a central conductor (not shown) of a shielded cable 12. The central conductor is axially surrounded by an inner insulation layer (not shown), a shield conductor 16 axially surrounding the inner insulation layer and an outer insulation layer 18 axially surrounding the shield conductor 16. The shielded cable 12 may include a single central conductor, e.g. coaxial cable, two central conductors, e.g. twinax cable, or more than two central conductors, e.g. shielded Category 6 cable. The shield conductor 16 is terminated by the electromagnetic shield terminal assembly 14.

Figure 2:
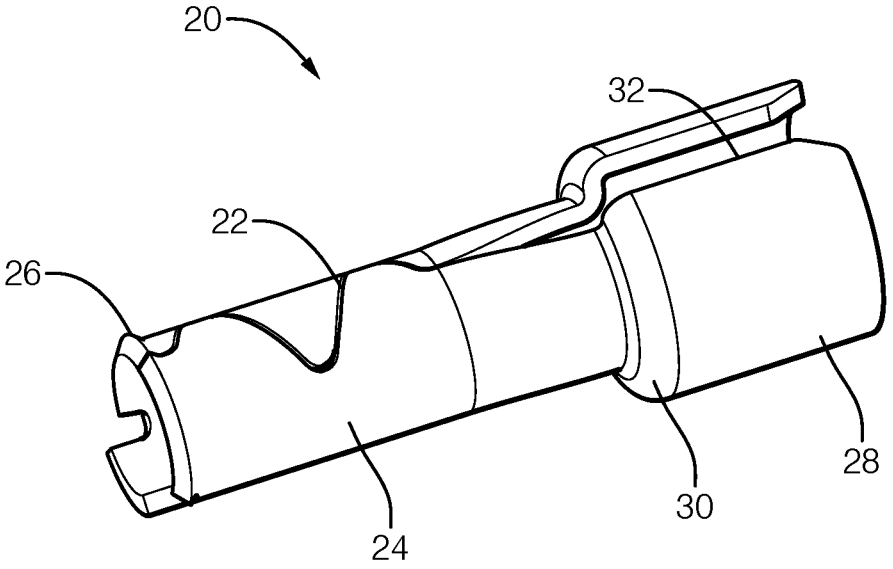
FIG. 2 is a perspective view of an inner ferrule of the electromagnetic shield terminal assembly of FIG. 1, according to one embodiment of the invention.

The electromagnetic shield terminal assembly 14 includes a tubular inner ferrule 20 shown in FIG. 2 that is formed from sheet metal, e.g. by stamping or blanking operation followed by a rolling operation. The inner ferrule 20 has a ferrule seam 22 that extends longitudinally in a tortuous path along an entire length of the inner ferrule 20. The inner ferrule 20 also has a flared attachment end 24 that is disposed under the shield conductor 16, i.e. intermediate the shield conductor 16 and the inner insulation layer. The flare 26 of the attachment end 24 forms a projecting ridge. Alternative embodiments of the inner ferrule may be seamless and may be formed from sheet metal by a deep draw stamping process or from a billet of metal by a machining process. The inner ferrule 20 also has a connection end 28 that has a larger diameter than the attachment end 24 and a ferrule transition segment 30 between the attachment end 24 and the connection end 28. The ferrule seam 22 defines a longitudinal slot 32 in the connection end 28.

Figure 3:
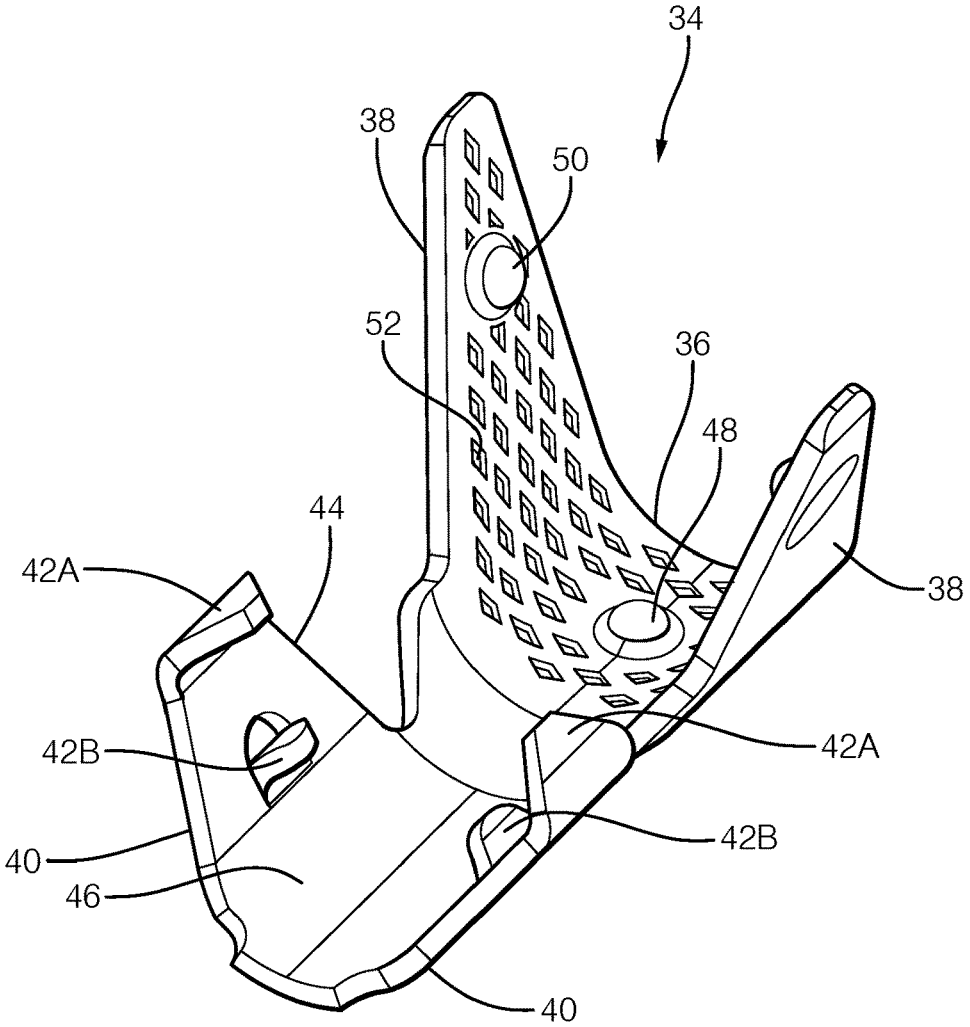
FIG. 3 is a perspective view of an outer ferrule of the electromagnetic shield terminal assembly of FIG. 1, according to one embodiment of the invention.

The electromagnetic shield terminal assembly 14 also includes a crimped outer ferrule 34 illustrated in FIG. 3 that is formed of sheet metal. The outer ferrule 34 has a cable attachment portion 36 that defines a pair of bypass crimp wings 38 that surround and are in electrical contact with the shield conductor 16. The outer ferrule 34 also has a pair of insulation crimp wings 40 that are attached to an end of the outer insulation layer 18 of the coaxial cable. As shown in FIG. 1, the flare 26 is located intermediate the bypass crimp wings 38 and the insulation crimp wings 40. The location of the flare 26 between the bypass crimp wings 38 and the insulation crimp wings 40 provides a robust mechanical stop for increased braid crimp retention. A width of the gap in the ferrule seam 22 is controlled by the outer ferrule 34 when it is crimped to the inner ferrule 20.

Each of the insulation crimp wings 40 defines a plurality of prongs 42 that have pointed ends that penetrate the outer insulation layer 18. Each insulation crimp wing 40 defines an upper prong 42A on a free end 44 of the insulation crimp wing 40 and a lower prong 42B located nearer a base 46 of the insulation crimp wing 40 than the upper prong 42A. The prongs 42 are generally radially evenly spaced about the circumference of the outer insulation layer 18, i.e. the four prongs 42 are spaced such that each prong 42 is radially offset by about 90 degrees from an adjacent prong 42. The even spacing of the prongs 42 provides a more uniform distribution of puling force to resist detachment of the outer ferrule 34 from the outer insulation layer 18. The prongs 42 also maintain the grip of the outer ferrule 34 to the outer insulation layer 18 if the outer insulation layer 18 shrinks due to aging or temperature exposure.

The cable attachment portion 36 defines a hemispherical first projection 48 that contacts and indents the shield conductor 16. Each of the bypass crimp wings 38 defines a hemispherical second projection 50 that contacts and indents the shield conductor 16. The second projections 50 are positioned opposite the first projection 48.

The cable attachment portion 36 defines a knurled pattern in an interior surface of the cable attachment portion 36. The knurled pattern includes a plurality of indentations 52. Each indentation in the plurality of indentations 52 has a rhomboid shape. A first pair of opposing inner corners define a generally longitudinal minor distance therebetween and a second pair of opposing inner corners different from said first pair of opposing inner corners define a major distance therebetween. The generally longitudinal minor distance is less than the major distance.

When used with a double shielded cable, i.e. a cable having a two piece shield conductor with a foil shield conductor surrounded by a braided wire shield conductor, the foil shield conductor may be disposed between the inner ferrule 20 and the inner insulation layer and the braided wire shield conductor may be disposed between the inner ferrule 20 and the outer ferrule 34.

Figure 4:
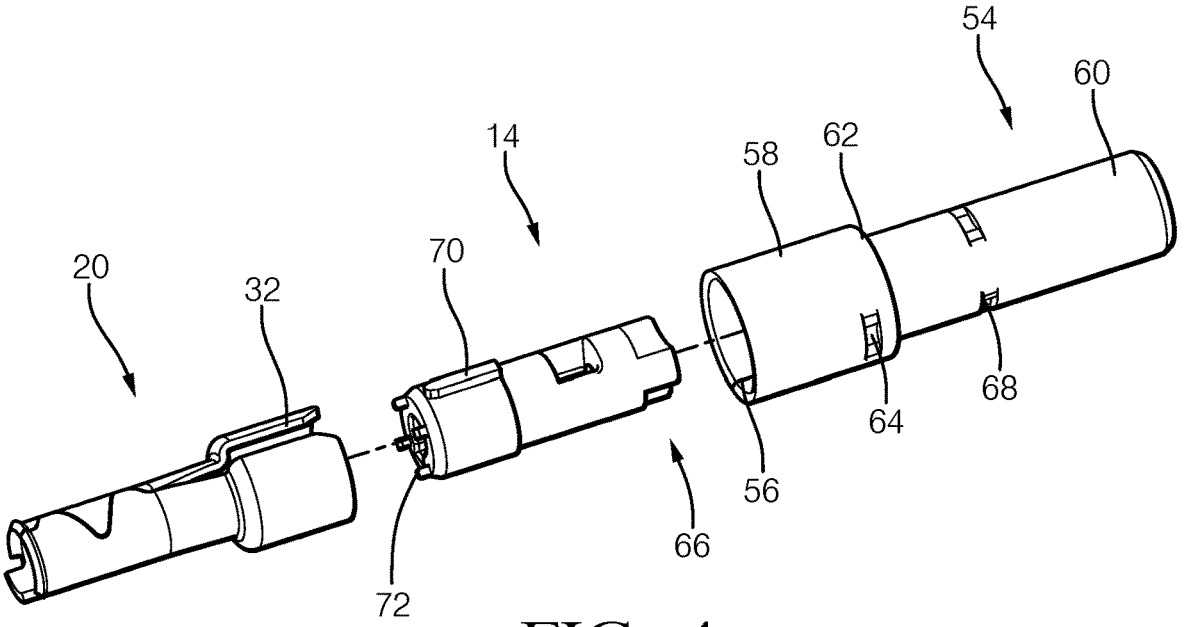
FIG. 4 is an exploded perspective view of the electromagnetic shield terminal assembly of FIG. 1, according to one embodiment of the invention.
Figure 5:
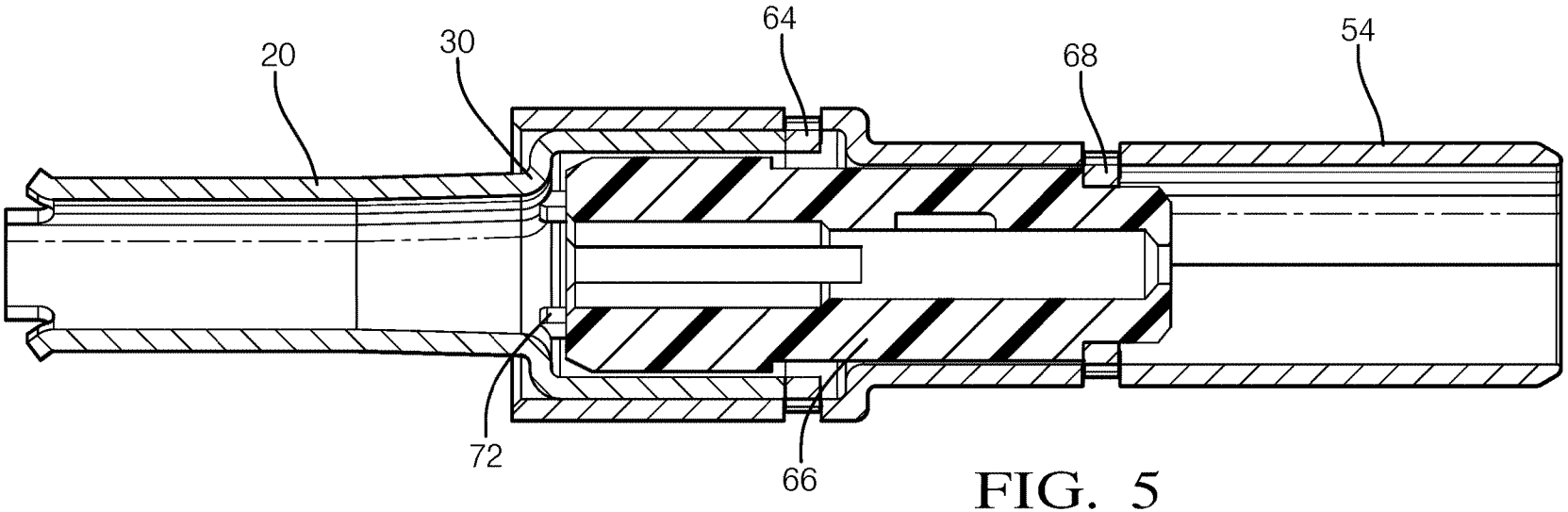
FIG. 5 is a cross section side view of the electromagnetic shield terminal assembly of FIG. 1, according to one embodiment of the invention.

The electromagnetic shield terminal assembly 14 further includes a tubular shield contact 54, best shown in FIGS. 4 and 5, that is electrically connected to the connection end 28 of the inner ferrule 20 that is located opposite the attachment end 24. The shield contact 54 is formed from sheet metal, e.g. by stamping or blanking operation followed by a rolling operation. The shield contact 54 has a contact seam 56 that extends longitudinally along an entire length of the shield contact 54. Alternative embodiments of the shield contact may be seamless and may be formed from sheet metal by a deep draw stamping process or from a billet of metal by a machining process. The shield contact 54 has a female receiving end 58 that is configured to receive the male connection end 28 of the inner ferrule 20 and a shield end 60 that is configured to surround and shield a terminal (not shown) attached to the inner conductor of the coaxial cable. The receiving end has a larger diameter than the shield end 60 and a shield transition segment 62 between the shield end 60 and the receiving end. The receiving end defines a first plurality of indentations 52 projecting into the receiving end, hereinafter referred to as ferrule stop 64 that limit the length of the connecting end of the inner ferrule 20 that is received within the receiving end of the shield contact 54.

The electromagnetic shield terminal assembly 14 additionally includes a tubular terminal insulator 66, best shown in FIGS. 4 and 5, that is formed of a dielectric material, such as polyamide, polyethylene, polybutylene terephthalate, or another electrically insulative polymer material. The terminal insulator 66 is disposed within the shield contact 54 and the connection end 28 of the inner ferrule 20. The shield end 60 of the shield contact 54 defines a second plurality of indentations 52 projecting into the shield end 60, hereinafter referred to as terminal stop 68 that limit the length of the connecting end of the inner ferrule 20 that is received within the receiving end of the shield contact 54. The inner ferule stop and terminal stop 68 ensure proper positioning of the connection end 28 and the terminal insulator 66 within the shield contact 54, thereby providing improved high frequency performance of the electromagnetic shield terminal assembly 14.

Figure 6:
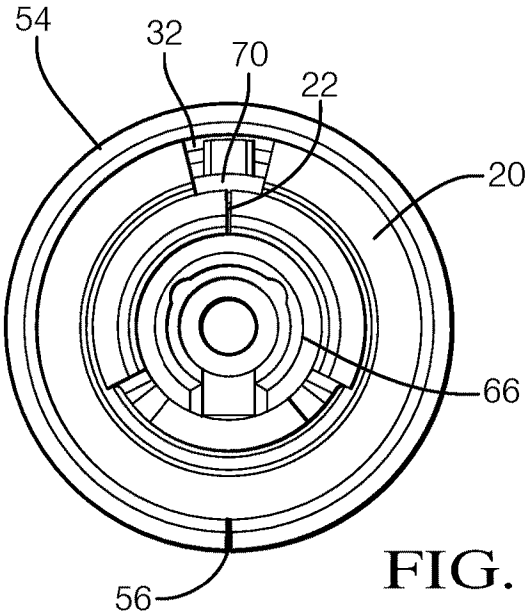
FIG. 6 is an end view of the electromagnetic shield terminal assembly of FIG. 1, according to one embodiment of the invention.

The terminal insulator 66 defines an orientation rib 70 that longitudinally extends along a portion of the terminal insulator 66. The orientation rib 70 is received within the slot of the inner ferrule 20 to aid in the insertion of the terminal insulator 66 into the inner ferrule 20 and to provide proper orientation of the terminal insulator 66 within the electromagnetic shield terminal assembly 14. The terminal insulator 66 also defines a plurality of crush ribs 72 that are configured to contact the ferrule transition segment 30. These crush ribs 72 ensure that the terminal insulator 66 is properly seated within the inner ferrule 20 and shield contact 54 and inhibits movement of the terminal insulator 66 within the electromagnetic shield terminal assembly 14. Proper seating of the terminal insulator 66 reduces electrical impedance fluctuations within the interface between the inner ferrule 20 and the shield contact 54. As shown in FIG. 6, the ferrule seam 22 and contact seam 56 are radially offset from one another, preferably by 180 degrees. This radial offset of the ferrule seam 22 and contact seam 56 provides increased mechanical strength and improved high frequency performance of the electromagnetic shield terminal assembly 14.

Figure 7:
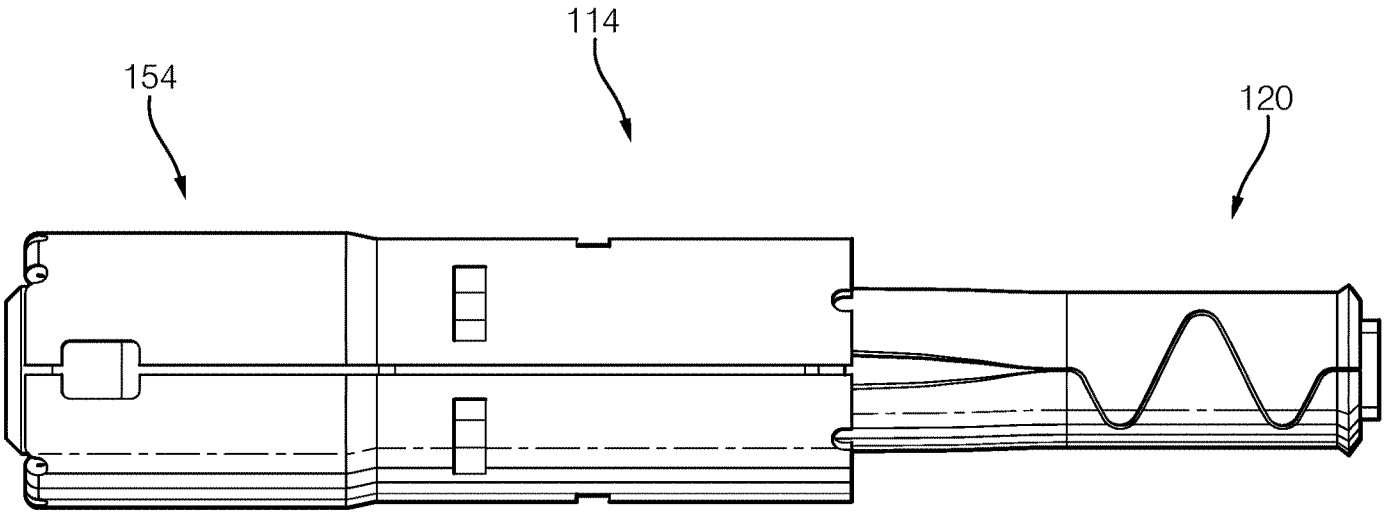
FIG. 7 is a side view of an electromagnetic shield terminal assembly, according to another embodiment of the invention.
Figure 8:
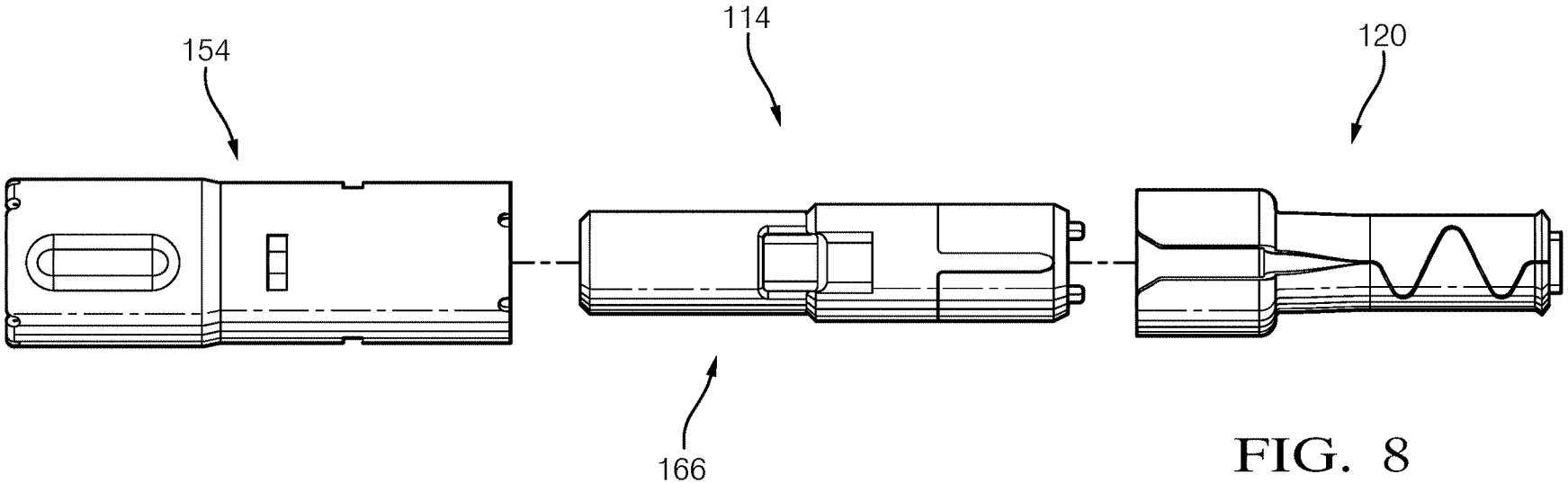
FIG. 8 is an exploded side view of the electromagnetic shield terminal assembly of FIG. 7, according to the another embodiment of the invention.

The electromagnetic shield terminal assembly 14 shown in FIGS. 1-6 illustrates an embodiment of a male electromagnetic shield terminal assembly. FIGS. 7 and 8 illustrate an embodiment of a female electromagnetic shield terminal assembly 114 having an inner ferule 120, a shield contact 154, terminal insulator 166 that is configured to mate with the electromagnetic shield terminal assembly 14.

Figure 9:
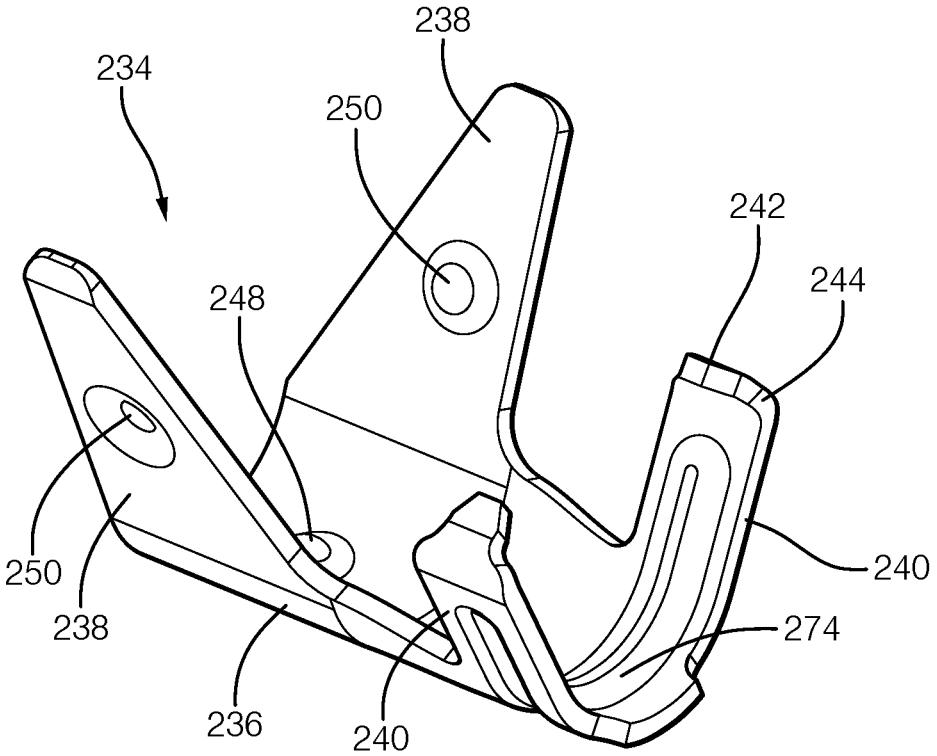
FIG. 9 is a perspective view of an outer ferrule of the electromagnetic shield terminal assembly of FIG. 1, according to yet another embodiment of the invention.
Figure 10:
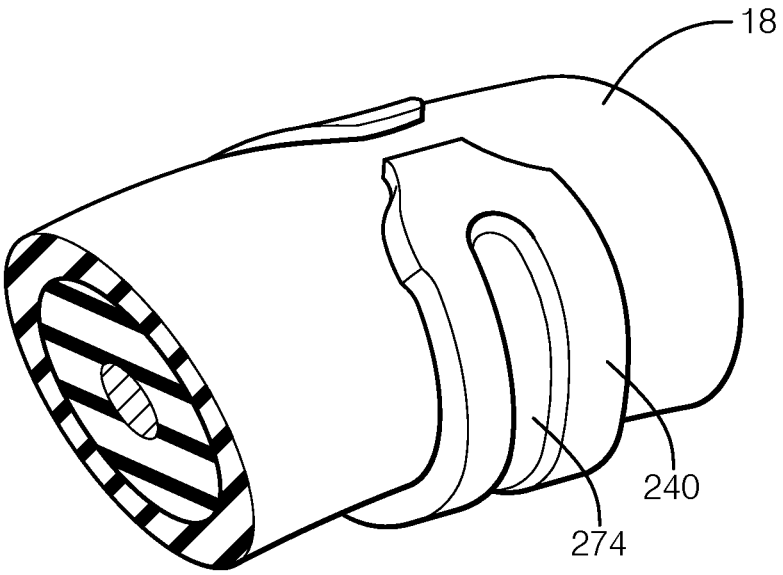
FIG. 10 is a perspective view of the outer ferrule FIG. 9 crimped to a coaxial cable, according to the yet another embodiment of the invention.

FIGS. 9 and 10 illustrate an alternative embodiment of the crimped outer ferrule 234. The outer ferrule 234 is formed of sheet metal. The outer ferrule 234 has a cable attachment portion 236 that defines a pair of bypass crimp wings 238 that surround and are in electrical contact with the shield conductor 16. The outer ferrule 234 also has a pair of insulation crimp wings 240 that are attached to an end of the outer insulation layer 18 of the coaxial cable. Each of the insulation crimp wings 240 defines a prong 242 on a free end 244 of the insulation crimp wing 240 that has a pointed end that penetrates the outer insulation layer 18. The prongs 242 maintain the grip of the outer ferrule 234 to the outer insulation layer 18 if the outer insulation layer 18 shrinks due to aging or temperature exposure. The cable attachment portion 236 also defines a embossed ridge or rib 274 projecting from the cable attachment portion 236 toward the shield conductor 16. The rib 274 extends laterally from one insulation crimp wing 240 to the other insulation crimp wing 240.

The cable attachment portion 236 defines a hemispherical first projection 248 that contacts and indents the shield conductor 16. Each of the bypass crimp wings 238 defines a hemispherical second projection 250 that contacts and indents the shield conductor 16. The second projections 250 are positioned opposite the first projection 248.

While this invention has been described in terms of the preferred embodiments thereof, it is not intended to be so limited, but rather only to the extent set forth in the claims that follow. For example, the above-described embodiments (and/or aspects thereof) may be used in combination with each other. In addition, many modifications may be made to configure a particular situation or material to the teachings of the invention without departing from its scope. Dimensions, types of materials, orientations of the various components, and the number and positions of the various components described herein are intended to define parameters of certain embodiments, and are by no means limiting and are merely prototypical embodiments.

Many other embodiments and modifications within the spirit and scope of the claims will be apparent to those of skill in the art upon reviewing the above description. The scope of the invention should, therefore, be determined with reference to the following claims, along with the full scope of equivalents to which such claims are entitled.

As used herein, 'one or more' includes a function being performed by one element, a function being performed by more than one element, e.g., in a distributed fashion, several functions being performed by one element, several functions being performed by several elements, or any combination of the above.

It will also be understood that, although the terms first, second, etc. are, in some instances, used herein to describe various elements, these elements should not be limited by these terms. These terms are only used to distinguish one element from another. For example, a first contact could be termed a second contact, and, similarly, a second contact could be termed a first contact, without departing from the scope of the various described embodiments. The first contact and the second contact are both contacts, but they are not the same contact.

The terminology used in the description of the various described embodiments herein is for the purpose of describing particular embodiments only and is not intended to be limiting. As used in the description of the various described embodiments and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

As used herein, the term "if" is, optionally, construed to mean "when" or "upon" or "in response to determining" or "in response to detecting," depending on the context. Similarly, the phrase "if it is determined" or "if [a stated condition or event] is detected" is, optionally, construed to mean "upon determining" or "in response to determining" or "upon detecting [the stated condition or event]" or "in response to detecting [the stated condition or event]," depending on the context.

Additionally, while terms of ordinance or orientation may be used herein these elements should not be limited by these terms. All terms of ordinance or orientation, unless stated otherwise, are used for purposes distinguishing one element from another, and do not denote any particular order, order of operations, direction or orientation unless stated otherwise.

We claim:

1. A shielded cable assembly, comprising:

a shielded cable having a central conductor axially surrounded by an inner insulation layer, a shield conductor axially surrounding the inner insulation layer and an outer insulation layer axially surrounding the shield conductor;

a tubular inner ferrule having a flared attachment end disposed intermediate the shield conductor and the inner insulation layer; and a crimped outer ferrule formed of sheet metal having a cable attachment portion that defines a pair of bypass crimp wings surrounding and in electrical contact with the shield conductor and having a pair of insulation crimp wings attached to an end of the outer insulation layer, wherein each insulation crimp wing defines a plurality of prongs having pointed ends that penetrate the outer insulation layer and wherein the flared attachment end of the inner ferrule is located intermediate the bypass crimp wings and the insulation crimp wings.

2. The shielded cable assembly according to claim 1, further comprising a tubular shield contact electrically connected to a connection end of the inner ferrule located opposite the flared attachment end.

3. The shielded cable assembly according to claim 1, wherein each of the insulation crimp wings defines an upper prong on a free end of the insulation crimp wing and a lower prong located nearer a base of the insulation crimp wing than the upper prong.

4. The shielded cable assembly according to claim 1, wherein each of the insulation crimp wings defines an upper prong on a free end of the insulation crimp wing and an embossed rib extending laterally across the insulation crimp wings.

5. The shielded cable assembly according to claim 1, wherein the cable attachment portion defines a first projection contacting and indenting the shield conductor, wherein the first projection is characterized as having a hemispherical shape.

6. The shielded cable assembly according to claim 5, wherein each bypass crimp wing defines a second projection contacting and indenting the shield conductor, wherein the second projection is positioned opposite the first projection, wherein the second projection is characterized as having a hemispherical shape.

7. The shielded cable assembly according to claim 1, wherein the inner ferrule has a seam extending longitudinally along an entire length of the inner ferrule that follows a tortuous path.

8. An electromagnetic shield terminal assembly configured for attachment to a shielded cable having a central conductor axially surrounded by an inner insulation layer, a shield conductor axially surrounding the inner insulation layer and an outer insulation layer axially surrounding the shield conductor, the electromagnetic shield terminal assembly comprising:

a tubular inner ferrule having a flared attachment end configured to be disposed intermediate the shield conductor and the inner insulation layer; and a crimped outer ferrule formed of sheet metal having a cable attachment portion that defines a pair of bypass crimp wings configured to surround and be in electrical contact with the shield conductor and having a pair of insulation crimp wings configured to be attached to an end of the outer insulation layer, wherein each insulation crimp wing defines a plurality of prongs having pointed ends that are configured to penetrate the outer insulation layer and wherein the flared attachment end of the inner ferrule is configured to be located intermediate the bypass crimp wings and the insulation crimp wings when the outer ferrule is crimped to the shielded cable.

9. The electromagnetic shield terminal assembly according to claim 8, further comprising a tubular shield contact electrically connected to a connection end of the inner ferrule located opposite the flared attachment end.

10. The electromagnetic shield terminal assembly according to claim 8, wherein each of the insulation crimp wings defines an upper prong on a free end of the insulation crimp wing and a lower prong located nearer a base of the insulation crimp wing than the upper prong.

11. The electromagnetic shield terminal assembly according to claim 8, wherein the cable attachment portion defines a first projection configured to contact and indent the shield conductor, wherein the first projection is characterized as having a hemispherical shape.

12. The electromagnetic shield terminal assembly according to claim 11, wherein each bypass crimp wing defines a second projection configured to contact and indent the shield conductor, wherein the second projection is characterized as having a hemispherical shape, wherein the second projection is positioned opposite the first projection.

13. The electromagnetic shield terminal assembly according to claim 8, wherein the inner ferrule has a seam extending longitudinally along an entire length of the inner ferrule that follows a tortuous path.

14. A shielded cable assembly, comprising:

a shielded cable having a central conductor axially surrounded by an inner insulation layer, a shield conductor axially surrounding the inner insulation layer and an outer insulation layer axially surrounding the shield conductor;

a tubular inner ferrule having an attachment end disposed intermediate the shield conductor and the inner insulation layer and a connection end located opposite the attachment end;

a tubular shield contact electrically having a receiving end in which the connection end is disposed and a shield end located opposite the receiving end, said shield contact defining a first plurality of indentations in the receiving end and a second plurality of indentations in the shield end, wherein the connection end is in contact with the first plurality of indentations; and a tubular terminal insulator disposed within the connection end and the receiving end, wherein the terminal insulator is in contact with the second plurality of indentations.

15. The shielded cable assembly according to claim 14, wherein the connection end defines a longitudinal slot and the terminal insulator defines a longitudinal orientation rib and wherein the orientation rib is disposed within the slot.

16. The shielded cable assembly according to claim 14, wherein the connection end has a larger diameter than the attachment end and the inner ferrule defines a ferrule transition segment between the connection end and the attachment end and wherein the terminal insulator defines a plurality of crush ribs that are in contact with and deformed by the ferrule transition segment.

17. The shielded cable assembly according to claim 14, wherein the inner ferrule has a ferrule seam extending longitudinally along an entire length of the inner ferrule and the shield contact has a contact seam extending longitudinally along an entire length of the shield contact and wherein the ferrule seam and the contact seam are radially offset from one another.

18. The shielded cable assembly according to claim 17, wherein the ferrule seam and the contact seam are radially offset from one another by 180 degrees.

19. An electromagnetic shield terminal assembly configured for attachment to a shielded cable having a central conductor axially surrounded by an inner insulation layer, a shield conductor axially surrounding the inner insulation layer and an outer insulation layer axially surrounding the shield conductor, the electromagnetic shield terminal assembly comprising:

a tubular inner ferrule having an attachment end configured to be disposed intermediate the shield conductor and the inner insulation layer and a connection end located opposite the attachment end;

a tubular shield contact electrically having a receiving end in which the connection end is disposed and a shield end located opposite the receiving end, said shield contact defining a first plurality of indentations in the receiving end and a second plurality of indentations in the shield end, wherein the connection end is in contact with the first plurality of indentations; and a tubular terminal insulator disposed within the connection end and the receiving end, wherein the terminal insulator is in contact with the second plurality of indentations.

20. The electromagnetic shield terminal assembly according to claim 19, wherein the connection end defines a longitudinal slot and the terminal insulator defines a longitudinal orientation rib and wherein the orientation rib is disposed within the slot.

21. The electromagnetic shield terminal assembly according to claim 19, wherein the connection end has a larger diameter than the attachment end and the inner ferrule defines a ferrule transition segment between the connection end and the attachment end and wherein the terminal insulator defines a plurality of crush ribs that are in contact with and deformed by the ferrule transition segment.

22. The electromagnetic shield terminal assembly according to claim 19, wherein the inner ferrule has a ferrule seam extending longitudinally along an entire length of the inner ferrule and the shield contact has a contact seam extending longitudinally along an entire length of the shield contact and wherein the ferrule seam and the contact seam are radially offset from one another.

23. The electromagnetic shield terminal assembly according to claim 22, wherein the ferrule seam and the contact seam are radially offset from one another by 180 degrees.

* * * * *